United States Patent [19]

Forry et al.

[11] Patent Number: 4,562,510

[45] Date of Patent: Dec. 31, 1985

[54] MATERIAL REPULSION BY ELECTROSTATIC CHARGE

[75] Inventors: John S. Forry, Manor Township, Lancaster County; John R. Garrick, Lancaster, both of Pa.

[73] Assignee: Armstrong World Industries, Inc., Lancaster, Pa.

[21] Appl. No.: 626,323

[22] Filed: Jun. 29, 1984

[51] Int. Cl.[4] ..... H05F 1/00

[52] U.S. Cl. ..... 361/212; 141/85; 141/98; 141/392; 361/215; 361/226; 361/230; 361/233

[58] Field of Search ..... 361/212, 215, 226, 230, 361/233; 138/145, 178; 406/45, 191; 428/36; 134/22.11, 166 C

[56] References Cited

U.S. PATENT DOCUMENTS 3,421,050 1/1969 Topper et al. ..... 361/233 X

FOREIGN PATENT DOCUMENTS 75808 5/1982 Japan ..... 406/191

*Primary Examiner*—Harry E. Moose, Jr.

[57] ABSTRACT

An apparatus and method for reducing material accumulation on processing equipment caused by electrostatic charge. By proper selection of materials, the equipment is designed to automatically develop a charge of the same polarity as that on the material being processed and thereby repel the material. The selection can be based on the relationship of the materials in the Triboelectric Series. The processing equipment is also electrically insulated from discharge paths so that the charge developed will not be dissipated or require high current generation to maintain the voltage required to repel the material particles.

8 Claims, 1 Drawing Figure

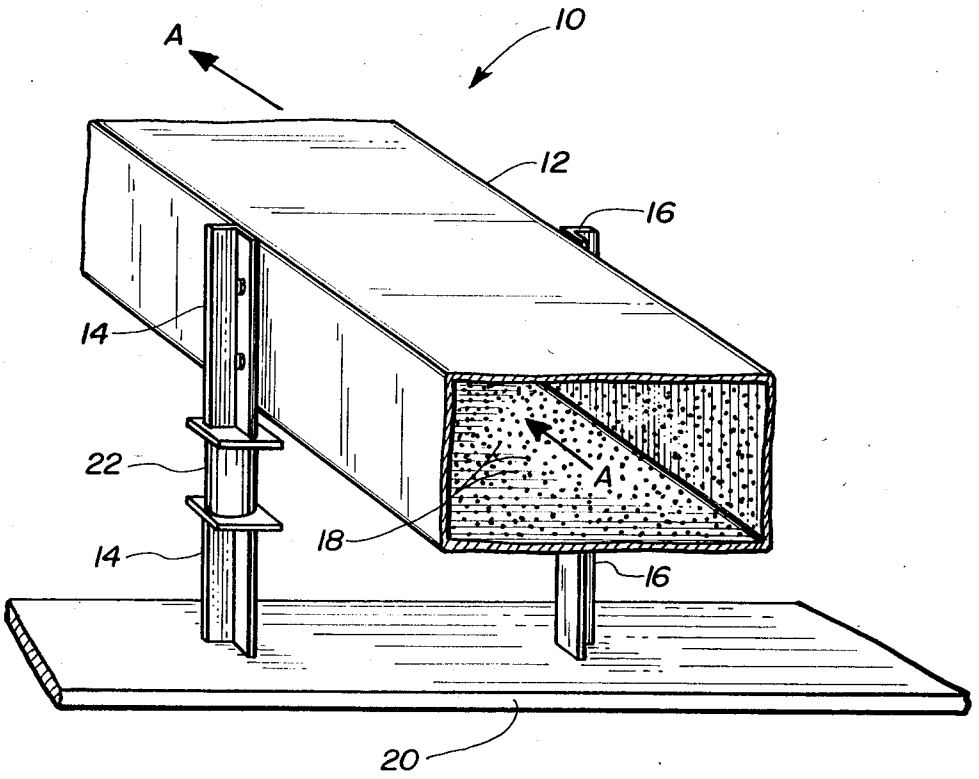
10
12
16
16
A
A
18
14
22
14
20

MATERIAL REPULSION BY ELECTROSTATIC CHARGE

SUMMARY OF THE INVENTION

This invention deals generally with electrical systems and devices and more specifically with preventing the detrimental effects of static electricity accumulation on processing equipment which tends to accumulate dust particles because of such static electricity.

The problems of undesirable dust collection and adhesion to surfaces because of incidental generation of static electricity is a common one. The accumulation of dust on phonograph records is a typical example of such a problem, and the difficulty of cleaning a plastic surface with a dry cloth is a frequent experience in the home. Many industrial processes have similar problems, but they occur on a much larger scale. Ducting through which non-conductive fibrous material is transported, either by airflow or gravity, is one such processing situation. The friction of the material against the inside surface of the ductwork then creates the static charge on either the fibrous material or the duct walls, or both, and the buildup of material on the duct walls can be so great in some cases that it interferes with material movement.

The most common solutions to this problem have been essentially the same in both the home and industry. One technique is to coat the surface with a conductive liquid, as do phonograph record cleaning solutions, and another alternative is to, in some manner, make one of the two materials conductive.

Another common technique, perhaps the most common, is to keep the humidity high in the location where the processing is taking place. This essentially furnishes a conduction path through the air to discharge the electrical charge. In many processes these approaches are completely unsatisfactory because they either modify the product or, in the case of high humidity with fibrous materials, the humidity makes fibers stick together and causes problems in processing.

The present invention uses just the opposite approach from previous techniques. Rather than discharge the electrical charge or prevent its generation, the present invention purposely generates a charge, but plans the polarity so that the material is repelled from, rather than attracted to, the parts of the processing machinery.

This is accomplished by selecting the materials of the processing equipment so that the friction of the material being processed will cause a charge of the same polarity to accumulate on both the equipment and the processed material. The basic electrostatic law of "like charges repel" then prevents material buildup on the equipment surfaces. However, to make the method work it is also necessary to properly insulate the machine parts fom ground, so that the electrostatic charge will not bleed off.

In one preferred embodiment, which is a duct within processing equipment for mineral wool, the first part of the selection process involves determining the charge which will develop on the processed material, mineral wool. This is best accomplished by the use of Triboelectric Series, a generally published list of the grouping of materials according to their electrostatic susceptibility. This series is usually presented as a simple list of materials, and while it can not be considered precise, the location of materials on the list can be considered as at least an indication of the relationship of materials to each other in regard to electrostatic properties. While few lists agree perfectly, and it is believed that material form and size cause variations, the general position of materials on mosts lists tends to be similar.

If a material is used which does not appear on an available Triboelectric Series, standard electrostatic charge evaluation techniques are available in the art which can be used to position new materials relative to each other.

The base action of the present invention is accomplished by selecting materials for use in the equipment which have a specific position on the Triboelectric Series list relative to the manufactured product. In one preferred embodiment this product is mineral wool, and, therefore, the materials of the parts of the machinery which are to be repellant must be located on the Series so that they take on the same charge as the mineral wool.

By using this selection process, and further by arranging that no electrically grounded portions of the machinery are located within the contact region of the processed material, the equipment can be made to repel the product and its dust and, therefore, stay quite clean and permit unrestricted movement of the product.

Moreover, a small quantity of extraneous material such as binder, doees not adversely affect the repulsion action, so that normal processing can include some secondary materials.

BRIEF DESCRIPTION OF THE DRAWING

The FIGURE is of a short section of machinery ductwork constructed according to the teachings of the present invention.

DETAILED DESCRIPTION OF THE INVENTION

A preferred embodiment of the present invention is shown in the FIGURE in which ductwork section 12, which is actually a short cross section of a much longer run of ductwork, is shown held by supports 14 and 16. Mineral wool particles 18 are constantly moving through ductwork 12 in direction A.

To the casual observer, the assembly 10 appears unique only in that supports 14 and 16 are electrically insulated from the electrical ground plane 20 upon which they rest by electrical insulators 22 (not visible on support 16). These insulators intercept and isolate the electrical discharge paths which would otherwise be available from duct 12 to electrical ground plane 20.

A more subtle unique feature of assembly 10 is the criteria upon which the material of ductwork 12 has been selected. The particular Triboelectric Series upon which the selection is based is as follows:

asbestos, glass, human hair, nylon, wool, fur, lead, polycarbonate, silk, glass fiber, mineral wool, paper, cotton, steel, sealing wax, hard rubber, acetate rayon, polyester, nickel, copper, synthetic rubber, orlon, saran, polyethylene, teflon, silicone rubber.

The above list is arranged to progress from materials which develop a positive charge when associated with materials following them toward the more negative materials. Therefore, selecting any two materials in the list, the first on the list will be positive relative to the second. The basis of the selection, therefore, is that the components which are desired to repel mineral wool be in a particular location on the list based on the charge previously taken on by the mineral wool.

The Triboelectric Series is used to determine the materials of construction as described below. First, the production material is located on the series. Second, the position of the other materials of components which first contact the production material and for which there are no alternatives is located in the series. In the preferred embodiment shown, and, in fact, in most other processing equipment, this material for which no practical substitute is available is the steel from which the material processing parts are constructed.

The relative locations of mineral wool and steel in the Triboelectric Series indicate that mineral wool will develop a positive charge after frictional contact with steel. It is, therefore, necessary to use other materials which precede mineral wool on the list, and will develop a positive charge relative to mineral wool. Furthermore, the more remote another material is from mineral wool in the Series, the higher will be the charge developed.

Therefore, the material selected for duct walls in the preferred embodiment shown in polycarbonate, which is properly located in the Series and is available commercially in sheet form, under the trademark LEXAN, by General Electric. The mere construction of a duct of polycarbonate does not, however, prevent accumulation of material attracted by static electricity because, typically, the construction of ducts also involves a metal support structure which permits any developed charge to drain off to an electrically grounded surface.

The preferred embodiment shown, therefore, also requires the placement of insulators 22 within support struts 14 and 16 to prevent the static electricity from discharging to electrical ground at the support surface 20 through metallic struts 14 and 16.

The buildup of the static charge during operation of the equipment actually takes some time and is also likely dependent on the quantity of material flowing. Thus, when the machinery first causes the mineral wool to begin moving in direction A down duct 12, a small accumulation of dust and mineral wool first occurs on the inside surfaces of the duct and particularly in the areas of contact between struts 14 and 16 and duct 12. This is likely so because the inner surfaces of duct 12 are initially uncharged, and as mineral wool 18 passes it the dust and particles of mineral wool are attracted to the neutral surface. However, as the movement of mineral wool past the inner surface continues with its occasional frictional contact, a positive charge builds up on the insulated duct. Since this charge is the same as that which is already on the mineral wool itself, the mineral wool particles are repelled from the surface of the duct and the accumulated material gradually is eroded until the duct becomes completely free of material.

In an opposite sense one need only short out insulator 22 to cause a buildup of mineral wool to begin on the duct area near strut 14.

Further indication of the importance of insulation is indicated by an interesting demonstration which can be made. When a person places his hand flat against the outside surface of transparent polycarbonate duct 12, material quickly begins to accumulate on the inside of the duct in an exact outline of the hand. However, when the hand is removed, the accumulation is gradually eroded away. Apparently, despite the insulating characteristics of the polycarbonate sheet itself and the relatively high resistance of the human body, the electrical leakage path is sufficient to discharge the electrostatic charge from the duct and to initiate accumulation of mineral wool.

Experimental operation also indicates that the results of the invention can still be achieved even when the material which is being processed is not pure, but is a mixture of several materials. In the preferred embodiment pictured, material repulsion was still satisfactory when the material flowing included powdered phenolic binder and other materials of up to 35% of the mixture by weight.

It, therefore, becomes clear that the invention requires not only the buildup of a specific polarity of electrical charge, but also that the equipment be well insulated to preserve that charge.

It is to be understood that the form of this invention as shown is merely a preferred embodiment. Various changes may be made in the design, function and arrangement of parts; equivalent means may be substituted for those illustrated and described; and certain features may be used independently from others without departing from the spirit and scope of the invention as defined in the following claims.

For example, based on the Triboelectric Series noted above, if cotton fibers are injected into a system and they have previously been negatively charged, selection of polyester, which is more negative in the series than cotton, would be an appropriate surface material to prevent cotton accumulation on the insulated surface.

What is claimed as new and desired to be secured by Letters Patent of the United States is:

1. A method of reducing the accumulation of a specific material on a surface due to the effects of electrostatic charge comprising:

selecting materials of construction for a surface so that the surface will develop the same polarity of electrostatic charge as does the specific material, the accumulation of which is undesirable;

constructing a surface from the selected materials; and electrically isolating the surface so that electrostatic charge developed on it will not be conducted away.

2. A method of reducing the accumulation of a specific material on a surface due to the effects of electrostatic charge caused by the interaction of the material and the surface comprising:

selecting materials of construction for the surface so that an electrostatic charge developed on the surface due to interaction with a specific material is the same polarity as the charge developed on the specific material;

constructing a surface from the selected materials; and electrically isolating the surface so that electrostatic charge accumulating on it will not be conducted away.

3. An apparatus with reduced electrostatic attraction of a specific material comprising:

an apparatus surface constructed of material selected to accumulate the same electrostatic charge polarity as accumulated by a specific material the attraction of which is undesirable; and supporting means supporting the apparatus surface and constructed with electrical insulating means to prevent the conduction away of an electrostatic charge developed on the supported apparatus surface.

4. The apparatus of claim 3 wherein the specific material is mineral wool.

5. The apparatus of claim 3 wherein the specific material is a mixture of mineral wool and other material wherein the mixture contains not less than 65 percent mineral wool by weight.

6. The apparatus of claim 3 wherein the specific material is essentially mineral wool and the apparatus surface is constructed of polycarbonate.

7. A method of reducing the accumulation of mineral wool on a surface due to the effects of electrostatic charge comprising:

selecting materials of construction for a surface so that the surface will develop the same polarity of electrostatic charge as does the mineral wool;

constructing a surface from the selected materials; and electrically isolating the surface so that electrostatic charge developed on it will not be conducted away.

8. A method of reducing the accumulation of mineral wool on a surface due to the effects of electrostatic charge caused by the interaction of the mineral wool and the surface comprising:

selecting polycarbonate as the material of construction for the surface so that an electrostatic charge developed on the surface is the same polarity as the charge developed on the mineral wool;

constructing a surface from the polycarbonate; and electrically isolating the surface so that electrostatic charge accumulating on it will not be conducted away.

* * * * *